US005318232A

United States Patent [19]

Busenhart et al.

[11] Patent Number: 5,318,232

[45] Date of Patent: Jun. 7, 1994

[54] METHOD AND APPARATUS FOR TRANSFERRING A THREAD FROM A FULL PACKAGE TO AN EMPTY TUBE

[75] Inventors: Peter Busenhart, Wiesendangen; Ruedi Schneeberger, Turbenthal; Kurt Schefer, Winterthur; Beat Hörler, Elgg, all of Switzerland

[73] Assignee: Maschinenfabrik Rieter AG, Winterthur, Switzerland

[21] Appl. No.: 907,557

[22] Filed: Jul. 2, 1992

[30] Foreign Application Priority Data

Jul. 4, 1991 [CH] Switzerland ..... 01983/91-8

[51] Int. Cl.[5] ..... B65H 67/048

[52] U.S. Cl. ..... 242/18 A

[58] Field of Search ..... 242/18 A, 18 PW, 25 A

[56] References Cited

U.S. PATENT DOCUMENTS

| | | | |
|---|---|---|---|
| 3,913,852 | 10/1975 | Lenk et al. | 242/18 A |
| 3,920,193 | 11/1975 | Gujer et al. | 242/18 A |
| 4,033,519 | 7/1977 | Abe et al. | 242/18 A |
| 4,210,293 | 7/1980 | Fromaget | 242/18 A |
| 4,216,920 | 8/1980 | Tambara et al. | 242/18 A |
| 4,613,090 | 9/1986 | Sugioka | 242/18 A |
| 4,641,793 | 2/1987 | Flüeli et al. | 242/18 A |
| 4,948,058 | 8/1990 | Behrens et al. | 242/18 A |
| 4,969,607 | 11/1990 | Busenhart et al. | 242/18 A |
| 5,016,829 | 5/1991 | Schippers et al. | 242/18 A |
| 5,102,060 | 4/1992 | Busenhart | 242/18 A |

FOREIGN PATENT DOCUMENTS

| | | | |
|---|---|---|---|
| 3744209 | 7/1989 | Fed. Rep. of Germany | 242/18 A |
| 60-61470 | 4/1985 | Japan . | |
| 60-153372 | 8/1985 | Japan . | |

*Primary Examiner*—Stanley N. Gilreath

[57] ABSTRACT

A thread winder includes a revolver on which two radially spaced mandrels are disposed for supporting thread-receiving tubes. Thread is wound onto one of the tubes located in a winding position and, when that tube is filled, the thread is transferred to the other, empty tube without interrupting the thread feed, by rotating the revolver. After the filled package is moved out of the winding position, a deflecting rod is swung to deflect the thread to a position where it can be grabbed by a transferring device. Then, the deflecting rod is swung away from the thread, and the transferring device is swung out to displace the thread toward a thread catcher disposed on the empty tube (or its mandrel), whereupon the thread is severed. A thread diverter is also swung out from the transferring device to shield the empty tube from the trailing end of the severed thread extending from the filled package.

13 Claims, 5 Drawing Sheets h1
h2
h3

14
19
17
13
6
25A
X
Z
11
3
17A
25
37
42

METHOD AND APPARATUS FOR TRANSFERRING A THREAD FROM A FULL PACKAGE TO AN EMPTY TUBE

BACKGROUND OF THE INVENTION

The invention relates to the transfer of a thread from a full package to an empty tube of a thread winding machine.

In the case of the winding of threads on winding machines having a revolver carrying the winding mandrels, the thread (which is still feeding at the termination of the winding operation) must be transferred from the full package onto the empty tube. This is brought about by a series of steps, including the turning of the revolver to shift the empty tube to the winding position. The transfer should occur without waste of thread, and an end ridge of thread should be formed on the full package, and a thread ridge should be formed on the new tube or its mandrel outside of the normal winding stroke.

Methods and devices for the execution of such a package change are known. A first type of such device moves the tube, or the winding mandrel, axially during the package change so that the ridge is produced at the desired position. These devices have the disadvantage that the winding mandrels, rotating on the revolver at high rotational speed, must be made axially movable, which involves a high cost for a mechanism supporting the winding mandrels on the revolver.

From U.S. Pat. No. 4,216,920, a winding device is known in which the thread being wound on a package is removed from a reciprocating guide by a first element in the form of a shifting guide and is deflected into a plane in which the catcher slot of the empty tube lies. A rodlike second element is fastened on the revolver carrying the winding mandrels and is situated downstream of the first element with reference to the direction of thread travel. This second element deflects the thread traveling to the full package. A third element in the form of a groove or a pawl or a change-over guide deflects the thread axially with respect to the point of contact of the thread and the second element in such a way that the thread comes to rest in the afore-mentioned plane of the catcher slot of the empty tube.

This known device has the disadvantage that the second element, which is connected permanently to the revolver and consequently can be rotated in synchronism with the winding mandrel, still has a deflected thread running at more than 90° in a first plane perpendicular to the winding mandrels (see FIG. 4 of U.S. Pat. No. 4,216,920) and, after the intervention of the third thread guide, additionally deflects the thread by a further angle of more than 45° (see FIG. 5 of U.S. Pat. No. 4,216,920). Such severe deflections, in conjunction with the high speed of the threads, might lead to thread damage or even to thread breaks. Furthermore, the deflection of the thread through the second element lasts for a relatively long period, starting shortly after the swiveling away of the full package from the friction roller up to the point of time of the thread transfer onto the empty tube, so that a considerable amount of thread might be affected.

An object of the present invention is to develop methods and apparatus for the transfer of the thread from a full tube to an empty tube, whereby the thread being wound on the full package during the transfer stage is only deflected for a very short time, and the deflection of the thread only undergoes a further deflection during the transfer into the catcher slot.

SUMMARY OF THE INVENTION

The present invention relates to methods and apparatus for transferring thread from a filled tube to an empty tube of a winding machine without interrupting the thread feed.

The machine comprises a movable revolver which carries spaced apart mandrels, each configured to support a tube. A thread catcher is disposed on the mandrel or its respective tube. The revolver is mounted for movement to shift a filled tube out of a winding position and shift an empty tube into the winding position. A traverse device is provided for reciprocating the thread along a winding stroke. A removing device is provided for removing the thread from the traverse device and positioning the thread in a transfer plane located outside of the winding stroke. A transferring device is movable relative to the revolver and includes a thread positioner. A thread deflector is provided which is movable relative to both the transferring device and the revolver for deflecting the thread. In operation, the revolver is moved to shift the filled tube out of the winding position while shifting an empty tube toward the winding position. The thread deflector is moved to engage the thread upstream of the filled tube and deflect the thread to the deflected position. The thread transferring device is moved toward the deflected position to cause the thread positioner to engage the thread upstream of the thread deflector. The removing device is actuated for removing the thread from the traverse and positioning the thread in the transfer plane. The thread transferring device is actuated to shift the thread toward the transfer plane and toward the empty tube so that the thread is caught by the thread catcher and is thereupon severed and wound onto the empty tube. Subsequent to the movement of the thread transferring device toward the deflected position, and prior to the actuation of the thread transferring device to shift the thread, the thread deflector is moved out of engagement with the thread.

In an apparatus aspect of the invention, the transferring device includes a first hook for engaging the deflected thread, and a second hook movable relative to the first hook for displacing the thread to the thread catcher along the axes of the mandrels.

In another apparatus aspect of the invention, the transferring device includes a thread diverter which is movable to an active position between the filled tube and the empty tube to oppose contact between the empty tube and the trailing end of severed thread projecting from the filled tube.

According to the invention, the thread still winding onto the full package is displaced by a transferring device which undergoes a relatively short stroke and which effects the ridge formation on the package immediately before the thread is transferred to the empty tube. All of thread which undergoes a deflection during the transfer is used for the formation of that ridge, so that any damage which may occur to the thread as a result of its deflection occurs to an area of thread not intended for further processing (e.g., processing into fabric).

The thread deflector, which is swiveled in for the deflection of the thread during the turning of the revolver, can swivel on a very small diameter, so that as a consequence, only a small spacing is necessary between the surfaces of the full package and the empty tube. In this way, packages with a relatively large diameter can be produced. The deflector swivels away from the winding area immediately after the transfer of the thread to the transferring device, so that the further progress of the transfer operation is no longer affected by the deflecting rod.

BRIEF DESCRIPTION OF THE DRAWINGS

The invention is more closely explained by means of the illustrated embodiments. It is shown:

FIGS. 3A–10A are schematic end views of the winding machine depicting eight stages of a thread transfer operation according to the invention.

FIGS. 3B–10B are schematic front elevational views of the winding machine, corresponding to FIGS. 3A–10A, respectively;

DETAILED DESCRIPTION OF PREFERRED EMBODIMENTS

Figure 1:
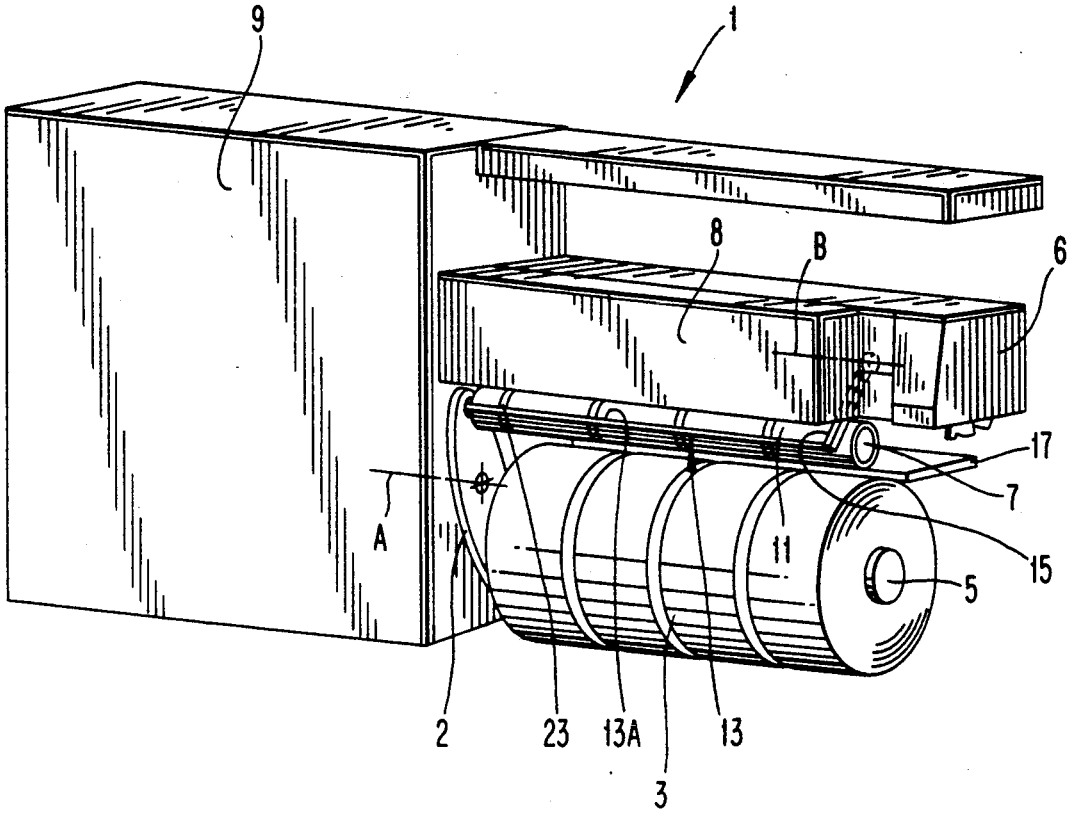
FIG. 1 is a schematic perspective view of a winding machine according to the present.
Figure 12:
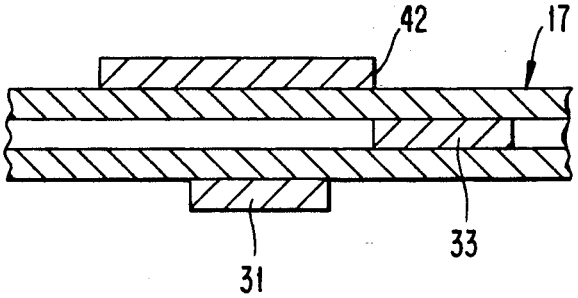
FIG. 12 is a sectional view taken along line 12—12 in FIG. 11.

FIG. 1 shows a winding machine 1 which contains two winding mandrels 5, 7 supported on a rotatable revolver 2, a thread displacement device 6 of known construction, as well as a machine casing 9, which contains the drive motors for the contact rollers 8, the displacement device 6 and the remaining units, as well as parts of the control mechanism. The revolver 2, carrying the two winding mandrels 5, 7, has a known construction and is supported to pivot about the axis A. The two winding mandrels 5, 7 are supported in cantilever fashion on the revolver 2, whereby the loading of the empty tubes 11 or the removal of the full yarn packages 3 can take place manually from the front or by means of an automatic doffer.

In front of the empty tube on the mandrel 7, a thread deflection device 13 is visible which is generally L-shaped in that it includes a horizontal arm 13A extending parallel to the axis of mandrels 5 and 7, and a crank arm 15 affixed to one end of the horizontal arm 13. The crank arm 15 is mounted to a carrier 10 for rotation about an axis B. The carrier is mounted on the machine casing 9. The end of a change sheet or transfer mechanism 17 is visible behind the winding mandrel 7, which is more specifically described later.

Figure 2:
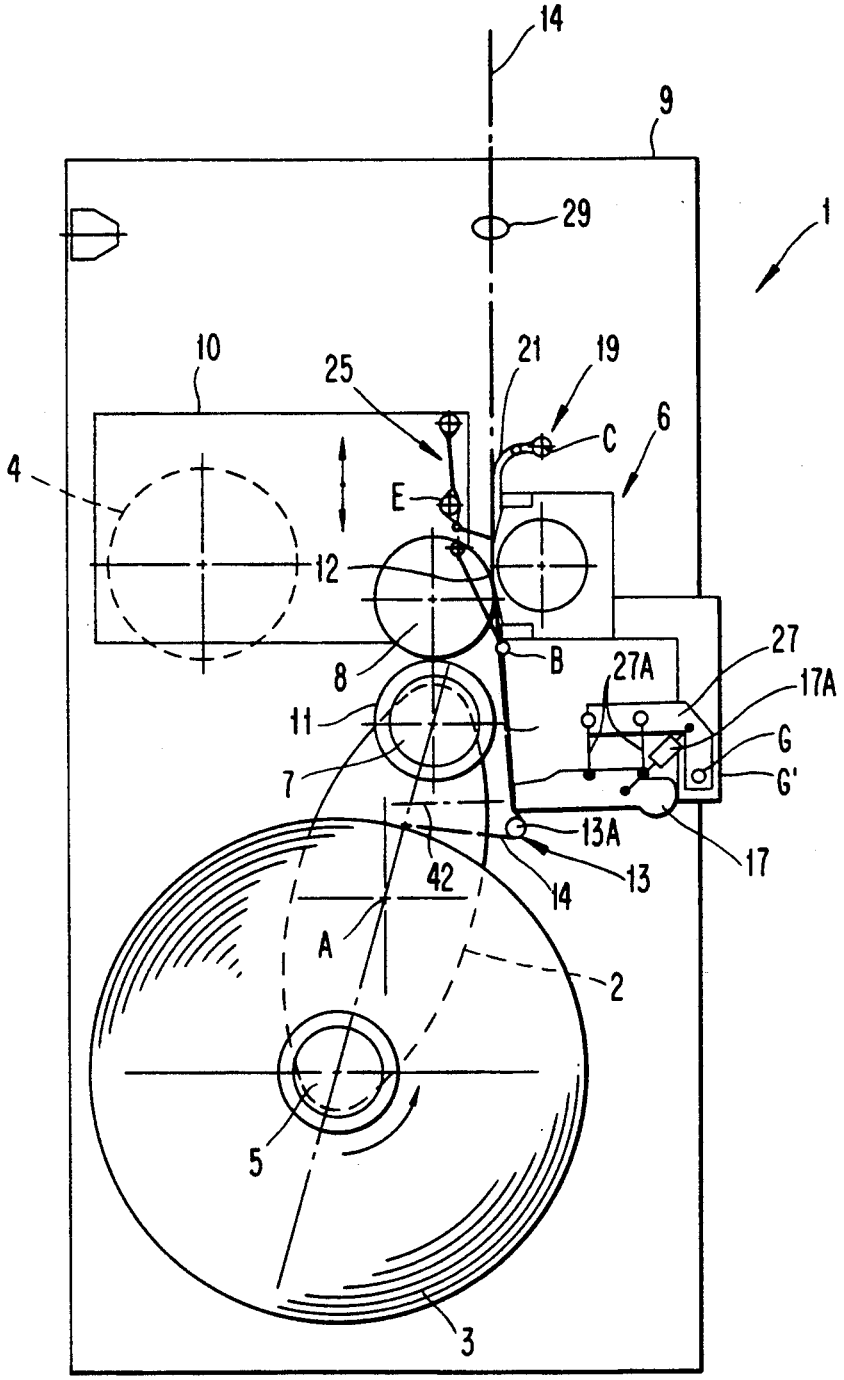
FIG. 2 is a schematic end elevational view of the winding machine.

As can be seen from FIG. 2, contact rollers 8, as well as the displacement device 6, are supported to move vertically relative to the casing 9 on the common carrier 10, so that the contact roller 8 can move upwards with the increasing diameter of the package 3 while maintaining a constant contact pressure thereagainst. The adjustment of the contact pressure and the device for moving the carrier 10 are conventional and are not an object of this invention. For this reason, they are not described in more detail. The thread 14, depicted by dash dotted lines, runs to the machine from above and is reciprocated by a thread traverse guide 12 of the reciprocating device 6 in a known way, over the width of the package 3 being produced.

Figures 7A, 7B, 8A, 8B, 9A, 9B, 10A, 10B:
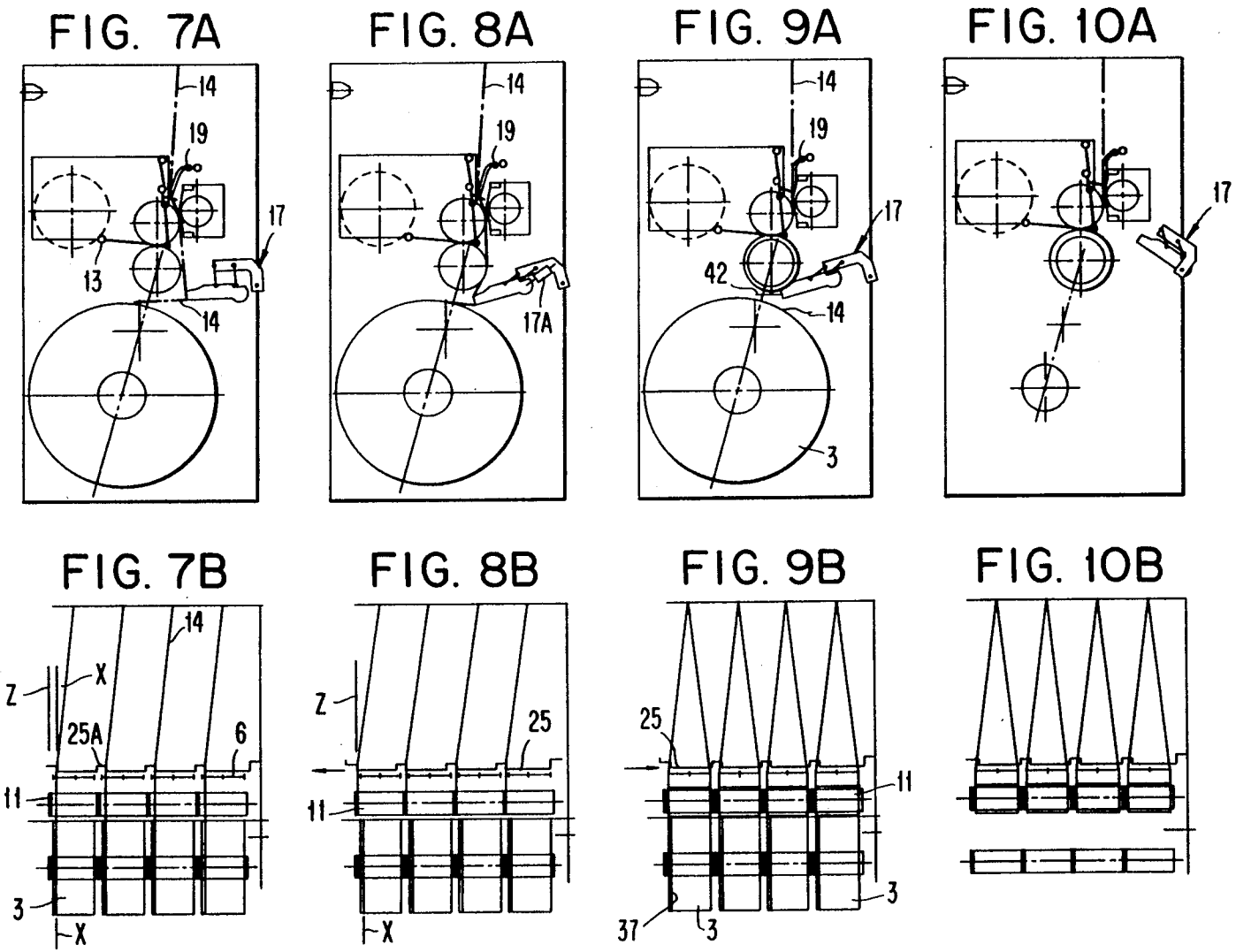

Above the reciprocating device 6, there is provided a thread removing device 19 for pushing the thread 14 out of the traverse guide. The thread removing device 19 can comprise a plate 21 swiveling about an axis C. Such a device is conventional and disclosed in U.S. Pat. No. 5,102,060 (e.g., see the swiveling thread-removing plate 134 disclosed in that patent). A swiveling guide plate or thread repositioned 25 swivels about, and slides along, an axis E in the path. Such a thread repositioner is conventional and disclosed in the afore-mentioned U.S. Pat. No. 5,102,060 (e.g., see the swiveling and sliding thread repositioner plate 132 disclosed in that patent). Thread 14 removed from the laterally shifting reciprocating device 6 by the removing device 19 is shifted laterally to be guided for travel within the transfer plane Z containing the thread catcher slot 23 of the tube 11 (see FIG. 8B). Thus, the removing device 19 and the thread repositioner 25 together constitute removing and repositioning means for removing the thread from the traverse device and laterally repositioning the thread to a transfer plane Z. Alternately, the catcher slot could be formed in the mandrel. A transfer mechanism 17 is arranged below the reciprocating device 6. The mechanism 17 is mounted to a holder 27 by two parallel arms, each of which is pivotably mounted to both the mechanism 17 and the holder 27. The holder 27 is mounted on the carrier 10 and is rotatable about an axle G. Ends of the axle are rotatably mounted in a bearing structure G'. An actuator 17A, such as a pressurized fluid cylinder, electric solenoid, etc., interconnects the transfer mechanism 17 and the holder 27 for shifting the transfer mechanism 17 between (i) a rest position (FIGS. 3A, 4A, 5A and 10A), (ii) a transfer or thread-capturing position (FIGS. 6A, 7A), and a thread delivery position (FIGS. 8A and 9A).

Figure 11:
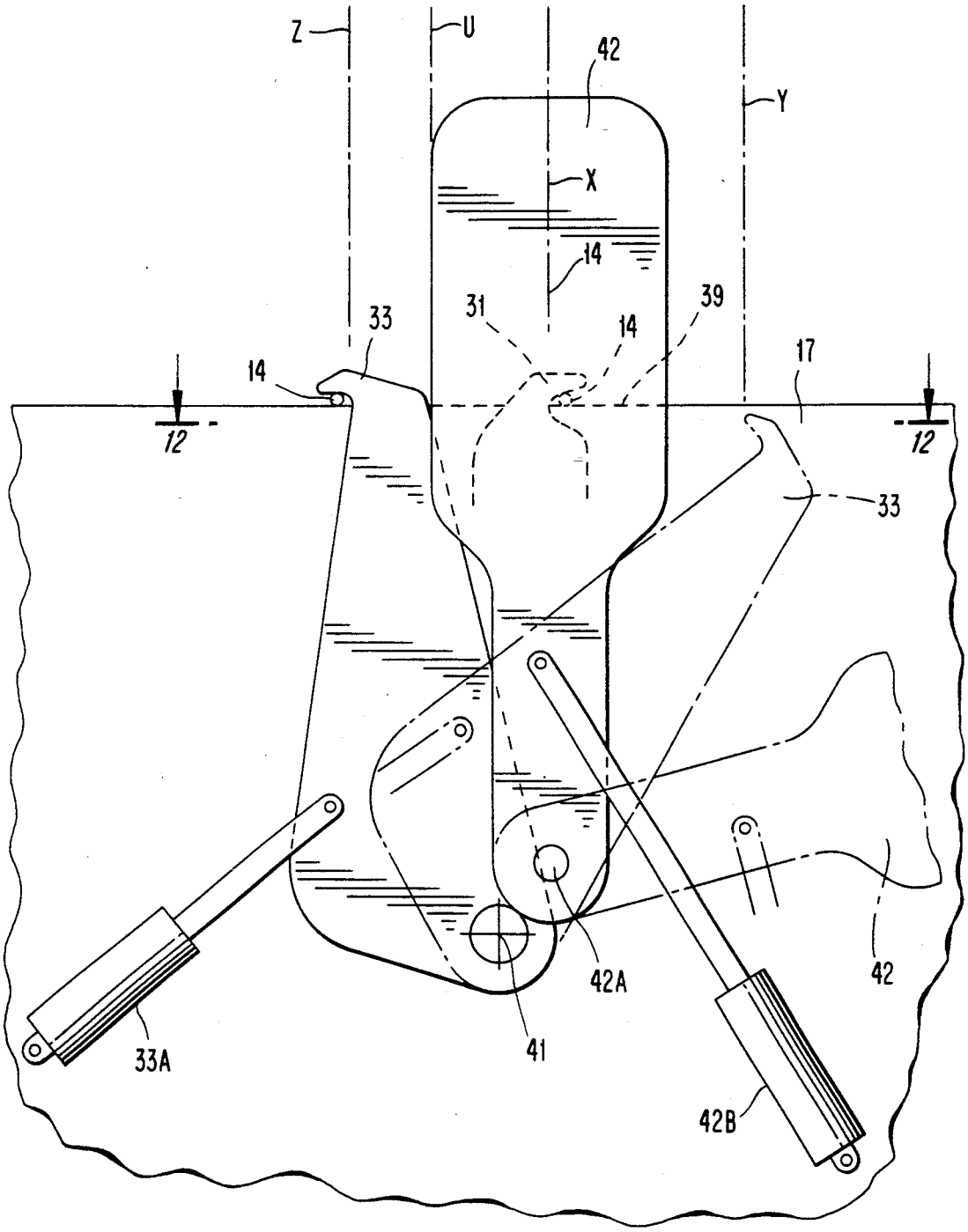
FIG. 11 is a schematic top fragmentary view of the thread transferring device.

Mounted fixedly on the transfer mechanism 17 is a thread positioner in the form of a stationary hook 3 which guides the thread for travel in a plane X (see FIG. 11). Mounted on the mechanism 17 for rotation about pivot 41 is a thread shifter in the form of a thread shifting member in the form of a rotary hook 33 which swivels in a plane spaced above the plane in which the hook 31 is disposed. An actuator 33A, such as a fluid cylinder, electric solenoid, etc., is provided for rotating the rotary hook 33 between a retracted position (shown in phantom lines in FIG. 11) and an extended position (shown in solid lines in FIG. 11). In its extended position, the rotary hook 33 positions the thread in the transfer plane Z.

Also mounted on the transfer mechanism 17 is a plate-shaped thread diverter member 42. That member 42 is freely rotatable about a pivot 42A within a plane disposed above the plane in which the hook 33 swivels. An actuator 42B, such as a fluid cylinder, electronic solenoid, etc., is provided for rotating the thread diverter member 42 between a retracted position (shown in phantom lines in FIG. 11) and an extended position (shown in solid lines in FIG. 11). That diverter member functions to prevent the loose trailing end of a severed thread of a package from contacting an empty tube, as will be subsequently explained. Phantom lines in FIG. 2 depict the location of the diverter member after it is extended, but the diverter member is not actually extended in FIG. 2.

The individual steps of the method will now be described with reference to FIGS. 3A to 10B. Although a plurality of packages 3 are being simultaneously wound about the axis A, the following description will be directed to only one of the packages, it being understood that all packages are similarly manipulated.

Figures 3A, 3B, 4A, 4B, 5A, 5B, 6A, 6B:
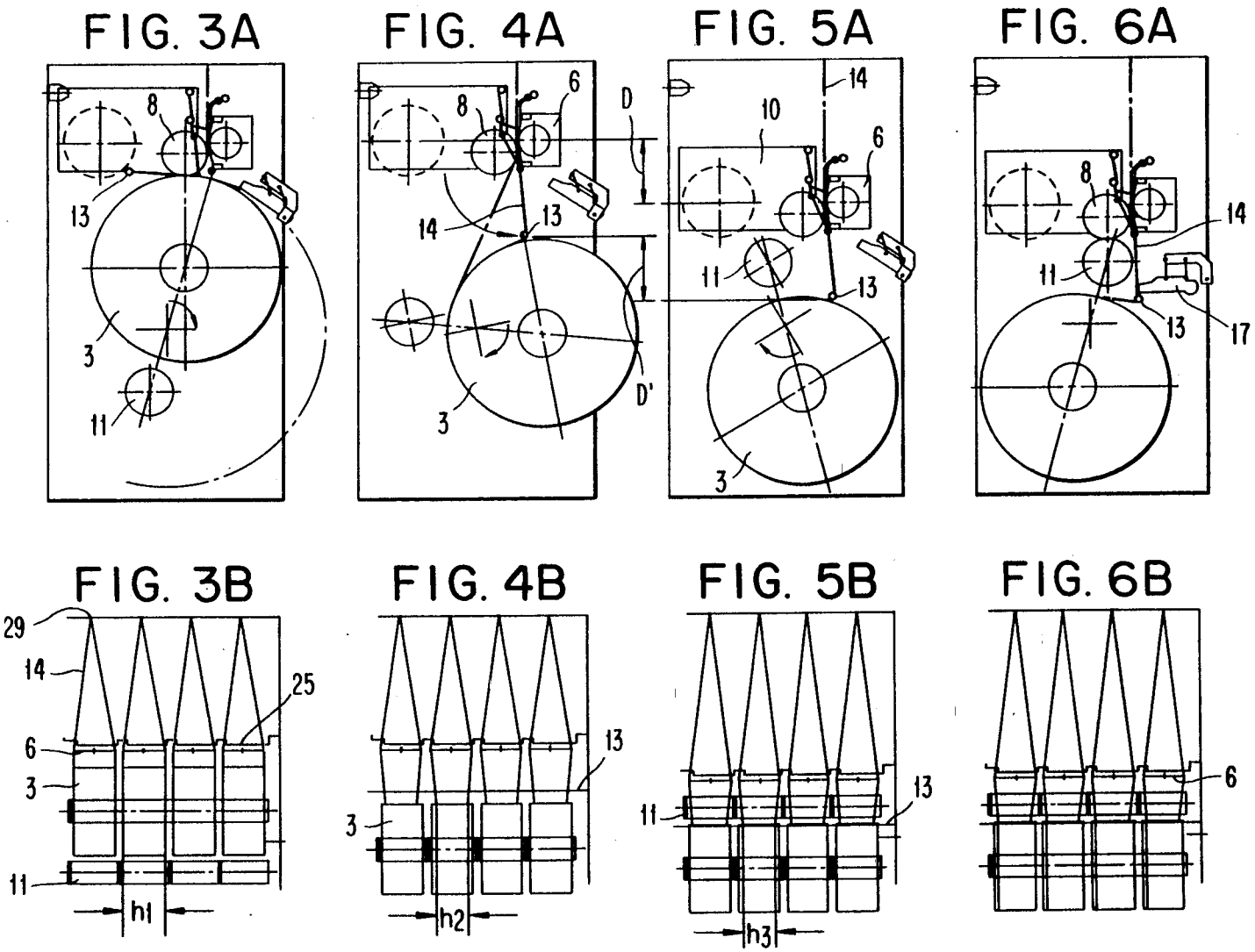

FIGS. 3A and 3B show the winding machine 1 at the start of a package change. The full package 3 is moved out of engagement with the contact roller 8 by the turning of the revolver in a clockwise direction. The thread 14, guided through an eyelet 29, continues to be reciprocated by the traverse guide 12 over the entire stroke h1 of the package 3, which is still rotating (FIG. 3B).

During the rotation of the revolver 2 through about 60°, it can be seen on the left hand side of FIG. 4A that the deflecting rod 13 is swivelled into the travel path of the thread 14 and has deflected the latter so far to the right that the thread is guided substantially tangentially past the rollers 8 and out of contact therewith. After deflecting around the rod 13, the thread runs onto the package 3. Due to the increase of the spacing between the traverse guide 12 and the point of entry of the thread onto the package 3, the stroke h2 has shortened (FIG. 4B).

It can be seen in FIGS. 5A, 5B, that with the further swivelling of the revolver 2, the carrier 10 has been further lowered, and consequently the length of thread from the traverse guide 12 to the package 3 has remained approximately constant between the steps depicted in FIGS. 4A and 4B. Thus, the stroke h3 also remains of the same order of magnitude as the stroke h2.

In FIGS. 6A and 6B, the empty tube has reached the contact rollers 8 and is set rotating thereby. (Alternatively, in the case of rapidly running machines, the empty tube 11, already displaced, will have been set rotating during the turning of the revolver 2 via an appropriate drive.) At this point in time, the holder 27 is swiveled, and the actuator 17A is energized, to bring the transfer mechanism 17 into its transfer position against the thread 14 at a location upstream of, i.e., above, the deflecting rod 13. The shifting guide plate 25 is then swiveled to a thread-receiving position. The transfer of the thread 14 to the shifting guide plate 25 is then effected by the cooperation of the traverse guide 12 and the removing plate 19 wherein the thread, when near one end of its transverse stroke, is pushed out of the traverse guide 12 and into a slot 25A of the oppositely located shifting guide plate 25 by the removing plate 19, which slot 25A lies in the transfer plane Z.

The thread, having been captured by the stationary hook 31 of the transfer plate during the travel of the thread within its stroke prior to being removed from the traverse guide, now travels from the slot 25A to the stationary hook 31 of the transfer plate 17 and then onto the package 3. Once the thread 14 has been caught by the hook 31, the deflecting rod 13 is swiveled back to its rest position (FIG. 7A).

Then, the shifting guide plate 25 is shifted laterally, and the actuator 17A is energized to swing the transfer mechanism 17 to its delivery position (see FIGS. 8A–B), whereupon the actuators 33A, 42B are energized. Accordingly, the swiveling hook 33 swivels counterclockwise to its extended position to shift the thread into the plane Z. Since the guide plate 25 has already shifted an upstream portion of the thread into the transfer plane Z, the thread now travels from slot 25A to the hook 33 within plane Z, and then travels diagonally from the hook 33 to the hook 31, and then travels from the hook 31 to the package 3 in plane X.

The plane X intersects the package 3 at a position thereon where an end ridge of thread 37 is to be formed. The plane Z contains the catcher slot 23 of the empty tube 11. (Note: the plane U in FIG. 11 lying between planes X and Z coincides with the end of the packing stroke h1 of the full package 3.)

When the transfer mechanism 17 is moved to its delivery position, not only is the hook 33 swiveled to its extended position, but the holder 27 is rotated so that the transfer plate swings on the arms 27A. Thus, the front edge 39 of the transfer mechanism 17 travels sufficiently far to the left in FIGS. 8A–B to press the thread 14 against the empty tube 11. Accordingly, the section of thread traveling in plane Z will be caught by the catcher slot 23, and cause the section of the thread 14 running to the full package 3 to be severed (see FIG. 9A).

So that the loose trailing end of the severed thread on the full package 3, which is still turning, does not come against the empty tube 11, the thread diverter member 42 is swung out by the actuator 42B to a position between the empty tube and the loose thread end (see FIG. 9A). The actuator 42B can be energized simultaneously with the actuator 33A, but it acts at a slower rate so that the thread diverter member does not reach its extended position until after the thread has been severed. The thread diverter thus acts as a barrier between the loose thread end and the empty package.

Directly after this stage, the removing plate 21 is swiveled back into the starting or rest position, so that the thread 14 is grasped in the traverse guide 12, and the build-up of a new package can be started. In the extremely short period between the grasping of thread by the slot 23 and the entry of thread into the traverse guide 12, a small ridge is formed on the tube 11 in the area of the catcher slot 23 due to the increased loading caused by the deflection.

Then, the transfer mechanism 17 is swung to its rest position (FIG. 10A), whereupon the full package 3, now having stopped rotating, is removed from the mandrel and exchanged for an empty tube 11 (FIGS. 10A and 10B).

The position of the revolver is now the same as it was in FIGS. 3A and 3B at the start of the thread changing operation. The carrier 10, with the reciprocating device 6 and the contact roller 8, is in an almost completely lowered position, as a result of the very small quantity of thread on the tube 11. With the increase in the diameter of the package, the carrier 10 also moves gradually upwards, until the package contains the predetermined quantity of thread and the changing operation according to the FIGS. 3A and 3B can recommence.

Instead of a friction drive for the tube 11 or the package 3, a direct drive can also be built-in for the mandrels carrying the tubes 11. For the direct drive, the package 3 is in contact with a driven tachometer roller, which is provided instead of the contact rollers 8.

It will be appreciated that the deflecting rod 13 engages the thread for only a brief period, i.e., it swings back to its rest position as soon as the hook 31 captures the thread. Also, the thread is not deflected through a severe angle during the transfer operation. Accordingly, any damage to the thread is minimized.

Although the invention has been described in connection with preferred embodiments thereof, it will be appreciated by those skilled in the art that additions, modifications, substitutions, and deletions not specifically described may be made without departing from the spirit and scope of the invention as defined in the appended claims.

What is claimed is:

1. A method for transferring thread from a filled tube to an empty tube of a winding machine without interrupting the thread feed, the winding machine comprising a movable revolver carrying spaced-apart mandrels each configured to support a tube rotatably about an axis, a thread catcher being disposed on the mandrel or its respective tube, the revolver being mounted for movement to shift a filled tube out of a winding position and shift an empty tube into the winding position, a traverse device for reciprocating the thread along a winding stroke, removing and repositioning means for removing the thread from the traverse device and laterally repositioning the thread to a transfer plane located outside of the winding stroke, a transferring device movable relative to the revolver and including a thread positioner and a thread shifting member movable relative to said thread positioner, and a thread deflector being movable relative to both the transferring device and the revolver for deflecting the thread, the method comprising the steps of:

A) moving the revolver to shift the filled tube out of the winding position while shifting an empty tube toward the winding position, B) moving the thread deflector to engage the thread upstream of the filled tube and deflect the thread to a deflected position, C) moving the thread transferring device toward the deflected position to cause the thread positioner to engage the thread upstream of the thread deflector and position the thread in a plane situated axially inwardly of said transfer plane with reference to said axis, D) actuating the removing and repositioning means for removing the thread from the traverse device and repositioning the thread to the transfer plane, E) actuating the thread shifting member of the thread transferring device to shift the thread toward the transfer plane and toward the thread catcher of the empty tube so that the thread is caught by the thread catcher and is thereupon severed and wound onto the empty tube, and F) subsequent to step C and prior to step E, moving the thread deflector out of engagement with the thread.

2. A method according to claim 1, wherein step F is performed prior to step D.

3. A method according to claim 1, wherein the transferring device includes a front edge, and step E includes the step of moving the transferring device such that the front edge thereof pushes the thread toward the empty tube.

4. A method according to claim 1, wherein step E includes engaging the thread by the shifting member upstream of the thread positioner.

5. A method according to claim 4, wherein step C comprises engaging the thread with the thread positioner to position the thread in a plane spaced inwardly from the transfer plane; the transferring device including a front edge, wherein step E includes moving the transferring device such that the front edge thereof pushes the thread toward the empty tube; the transferring device including a thread diverter swingably mounted on a housing of the transferring device, wherein step E further includes swinging the thread diverter outwardly to oppose contact between the empty tube and the severed trailing end of thread wound on the filled tube.

6. A method according to claim 1, wherein the thread positioner positions the thread in a plane spaced inwardly from the transfer plane, so that a ridge of thread is wound on the filled tube subsequent to step C.

7. A method according to claim 1, wherein the transferring device includes a thread diverter movably mounted on a housing of the transferring device, wherein step E includes swinging the thread diverter outwardly to oppose contact between the empty tube and the severed trailing end of thread projecting from the filled tube.

8. A winding machine for winding thread onto a tube and transferring the thread from a filled tube to an empty tube without interrupting the thread feed, the winding machine comprising a casing, a movable revolver mounted on the casing and carrying spaced-apart mandrels each configured to support a tube, a thread catcher being disposed on the mandrel or its respective tube in a first plane, the revolver being mounted for movement to shift a filled tube out of a winding position and shift an empty tube into the winding position, a drive member for driving a tube disposed in the winding position, a traverse device for reciprocating the thread within a winding stroke, a removing device for removing the thread from the traverse device, a thread deflector movable relative to the revolver for deflecting the thread, and a transferring device movable relative to the revolver and including a first hook for engaging and positioning the deflected thread in a second plane, and a second hook movable relative to the first hook for shifting the thread toward said first plane of the thread catcher in a direction generally parallel to the axes of the mandrels while said thread remains engaged with said first hook.

9. A winding machine according to claim 8 including a carrier mounted for vertical movement on the casing; wherein the traverse device, the removing device, the thread deflector, and the transferring device being mounted on the carrier; the thread deflector being arranged for swinging movement along a path passing between the filled tube and the empty tube.

10. A winding machine according to claim 8, wherein the second hook is mounted for swinging movement about a substantially vertical axis.

11. A winding machine according to claim 8, wherein the transferring device includes a thread diverter movable to an active position between the filled tube and empty tube to oppose contact between the empty tube and the trailing end of severed thread projecting from the filled tube.

12. A winding machine for winding thread onto a tube and transferring the thread from a filled tube to an empty tube without interrupting the thread feed, the winding machine comprising a casing, a movable revolver mounted on said casing and carrying spaced-apart mandrels each configured to support a tube, a thread catcher being disposed on the mandrel or its respective tube, a drive member for driving a tube disposed in the winding position, a traverse device for reciprocating the thread, a removing device for removing the thread from the traverse device, a thread deflector for deflecting the thread, and a transferring device mounted on said casing for movement relative to said revolver and including a shifting member for shifting the deflected thread to the thread catcher, whereupon the thread becomes severed, the transferring device further including a thread diverter movable to an active position between the filled tube and empty tube to oppose contact between the empty tube and the trailing end of severed thread projecting from the filled tube.

13. A winding machine according to claim 12, wherein the thread diverter comprises a plate mounted for swinging movement on the transferring device.

* * * * *